US007709719B2

(12) United States Patent
Osuga

(10) Patent No.: US 7,709,719 B2
(45) Date of Patent: May 4, 2010

(54) KEYBOARD APPARATUS FOR ELECTRONIC MUSICAL INSTRUMENT

(75) Inventor: Ichiro Osuga, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/935,329

(22) Filed: Nov. 5, 2007

(65) Prior Publication Data

US 2008/0105106 A1 May 8, 2008

(30) Foreign Application Priority Data

Nov. 6, 2006 (JP) ..... 2006-300797

(51) Int. Cl.
*G10C 3/12* (2006.01)

(52) U.S. Cl. ..... 84/437; 84/423 R

(58) Field of Classification Search ..... 84/437, 84/423 R, 433

See application file for complete search history.

(56) References Cited

U.S. PATENT DOCUMENTS 4,840,104 A 6/1989 Ishida et al.
5,323,679 A * 6/1994 Riday ..... 84/423 R
5,559,297 A * 9/1996 Yoshikawa et al. ..... 84/433
2004/0003708 A1* 1/2004 Buchla ..... 84/724
2004/0074376 A1* 4/2004 Varme ..... 84/483.2

FOREIGN PATENT DOCUMENTS

JP 62158757 A * 7/1987
JP 63-213892 9/1988
JP 6-31938 2/1994

* cited by examiner

*Primary Examiner*—Jianchun Qin
(74) *Attorney, Agent, or Firm*—Morrison & Foerster LLP

(57) ABSTRACT

A keyboard apparatus for an electronic musical instrument having white keys and black keys capable of providing a satisfactory tactile impression, having a satisfactory appearance, and suppressing a difference in tactile impression between when the white keys are played and when the black keys are played. Each white key has a base portion and an upper plate portion fixed to an upper surface of the base portion, and each black key has a key main body portion. The upper plate portion is formed by a porous member having sweat-absorbability and made of a material comprised of an AS resin mixed with stone powder and a white-colored colorant. Each black key is made of the same material as that of the upper plate portion, except for a colorant mixed therein.

13 Claims, 4 Drawing Sheets

KEYBOARD APPARATUS FOR ELECTRONIC MUSICAL INSTRUMENT

BACKGROUND OF THE INVENTION

1. Field of the Invention

The present invention relates to a keyboard apparatus for an electronic musical instrument, in which white keys and black keys are supported by a key support member for pivotal motion.

2. Description of the Related Art

Heretofore, ivory and ebony wood have been said to be the best raw materials for white keys and for black keys of a keyboard apparatus for an electronic musical instrument. However, especially ivory can no longer be practically used because of exhaustion of resources and for preservation of resources. As an ivory substitute for white keys, a so-called artificial ivory has been developed which is excellent in sweat-absorbability, surface hardness, friction coefficient, etc. (see, Japanese Patent Publication No. 06-031938).

An ebony-wood substitute as a raw material for black keys has also been researched. However, there has been a consistent assumption that ebony wood is the best material for black keys, and the research is still focused to find a material having properties closely similar to those of ebony wood.

The reason why ivory and ebony wood were used for white keys and black keys is considered that they were selected from a variety of materials available in the desired amount from the natural world. However, from the viewpoint of touch feeling (tactile impression at fingers) during performance, these natural materials do not always mean the most excellent materials. In deed, recent developments of highly advanced artificial materials indicates that fundamental rethinking should be done beyond the traditional idea of material selection.

It is considered that touch feeling, which is a property of keys required to achieve the desired performance, should be the same between the white keys and the black keys. Nevertheless, ivory or ivory-like material differs in material from ebony wood or ebony-wood-like material, and as a result, touch feeling is not completely the same between the white keys and the black keys.

Under the assumption that the restriction on color selection that white keys and black keys must be respectively colored white and black is to be accepted, the use of white keys and black keys made of the same material does not pose a problem but is rather advantageous in improving the uniformity of touch feeling between the white keys and the black keys.

In the case of using an artificial material such as artificial ivory for white keys, the resultant white keys have an artificial appearance, posing a problem of failing to provide an upgraded appearance.

Moreover, in the case using an artificial material only for upper faces of the keys, a problem is caused that the tactile impression differs between when a glissando is played and when a normal performance is performed.

SUMMARY OF THE INVENTION

The present invention provides a keyboard apparatus for an electronic musical instrument having white keys and black keys capable of providing a satisfactory tactile impression to a user, having a satisfactory appearance, and reducing a difference in tactile impression between when the white keys are played and when the black keys are played.

The present invention provides a keyboard apparatus for an electronic musical instrument having white keys capable of providing a satisfactory tactile impression to a user, having a satisfactory appearance, and reducing an artificial impression of material.

The present invention provides a keyboard apparatus for an electronic musical instrument having white keys capable of providing a satisfactory tactile impression to a user, having a satisfactory appearance, and reducing a difference in tactile impression between when the white keys are played in a usual performance and when the white keys are played in a glissando.

According to a first aspect of the present invention, there is provided a keyboard apparatus for an electronic musical instrument comprising a plurality of white keys each having an upper surface and supported for pivotal motion by a key support member, and a plurality of black keys each having an upper surface and supported for pivotal motion by the key support member, wherein the upper surfaces of the white keys are each formed by a first porous member having sweat-absorbability, and the upper surfaces of the black keys are each formed by a second porous member that is different only in colorant from the first porous member.

With the keyboard apparatus of this invention, the white keys and the black keys can provide a satisfactory tactile impression to a user, can have a satisfactory appearance, and can suppress a difference in tactile impression between when the white keys are played and when the black keys are played to a minimum.

The upper surfaces of the white keys can be different in surface roughness from the upper surfaces of the black keys.

In that case, the white keys and the black keys can have different appearances from each other, making it possible to suppress an artificial impression thereof.

Each of the white keys can have a front edge thereof formed by a member which is the same, including a colorant, as the first porous member forming the upper surfaces of the white keys.

In that case, the upper surface and the front surface of each white key can have a sense of uniformity, thereby having an upgraded appearance.

The upper surfaces of the white keys can be adapted to reflect visible light and each can have a visible light reflectance that varies depending on a position on the upper surface of each of the white keys so as not to be uniform throughout the upper surface of the white key.

In that case, an artificial impression of the material of the white keys can be suppressed.

Each of the white keys can have a side surface thereof including a visible part that becomes externally visible when at least an adjacent key is in a depressed state, the visible part being formed by a member that is the same as the first porous member forming the upper surfaces of the white keys.

In that case, the appearance of the white keys can be improved.

Each of the white keys can include a base portion thereof having an upper surface and forming a key main body, and a plate-like upper plate body fixed to the upper surface of the base portion, and the upper plate body can be formed by the first porous member.

Each of the first and second porous members can mainly be comprised of a resin.

According to a second aspect of the present invention, there is provided a keyboard apparatus for a musical instrument comprising a plurality of white keys each having an upper surface thereof adapted to reflect visible light and supported for pivotal motion by a key support member, and a plurality of black keys each having an upper surface and supported for pivotal motion by the key support member, wherein the upper surfaces of the white keys are each made of a porous member having sweat-absorbability, and each have a visible light reflectance varying depending on a position on the upper surface of the white key so as not to be uniform throughout the upper surface of the white key.

With the keyboard apparatus according to the second aspect of this invention, the white keys can provide a satisfactory tactile impression, can have a satisfactory appearance, and can suppress an artificial impression of the material of the white keys. This keyboard apparatus can be applied not only to an electronic musical instrument but also to an acoustic musical instrument.

Each of the white keys can include a base portion thereof having an upper surface and forming a key main body, and a plate-like upper plate body fixed to the upper surface of the base portion and formed by the porous member.

The porous member can mainly be comprised of a resin.

According to a third aspect of this invention, there is provided a keyboard apparatus for an electronic musical instrument comprising a plurality of white keys having an upper surface and supported for pivotal motion by a key support member, and a plurality of black keys having an upper surface and supported for pivotal motion by the key support member, wherein the upper surfaces of the white keys are each formed by a porous member having sweat-absorbability, and wherein the white keys each have a side surface thereof including a visible part that becomes externally visible when at least an adjacent key is in a depressed state and that is formed by a member that is the same as the porous member of the upper surface of the white key.

With the keyboard apparatus according to the third aspect of this invention, the white keys can provide a satisfactory tactile impression, can have a satisfactory appearance, and can suppress a difference in tactile impression between when the white keys are played in a normal performance and when the white keys are played in a glissando.

The white keys each can include a base portion thereof having an upper surface and forming a key main body, and a plate-like upper plate body fixed to the upper surface of the base portion and formed by the porous member.

The porous member can mainly be comprised of a resin.

Further features of the present invention will become apparent from the following description of exemplary embodiments with reference to the attached drawings.

DETAILED DESCRIPTION OF THE PREFERRED EMBODIMENTS

The present invention will now be described in detail below with reference to the drawings showing preferred embodiments thereof.

Figure 1:
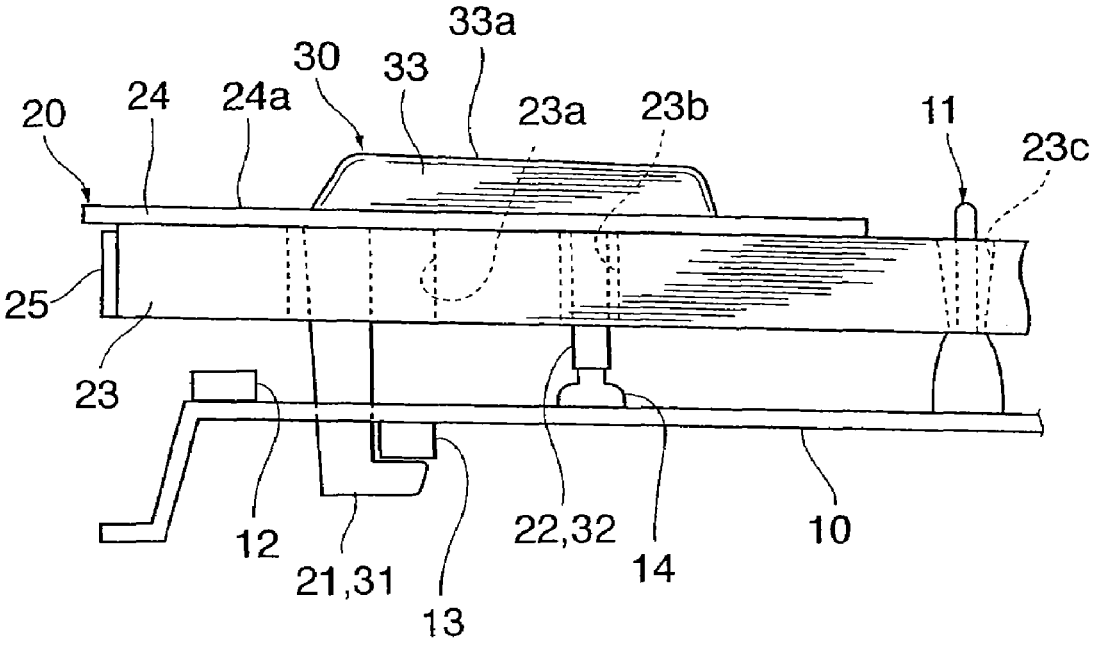
FIG. 1 is a fragmentary schematic side view showing the construction of a keyboard apparatus for an electronic musical instrument according to a first embodiment of this invention.

FIG. 1 is a fragmentary schematic side view showing the construction of a keyboard apparatus for an electronic musical instrument according to a first embodiment of this invention. An illustration of a rear half of the keyboard is omitted in FIG. 1.

The keyboard apparatus includes a key frame (key support member) 10 having a key fulcrum portion 11 mounted thereon by which a plurality of white keys 20 and a plurality of black keys 30 are supported for pivotal motion. The key frame 10 is provided with a lower limit stopper 12 for restricting key depression end positions of the white keys 20 and an upper limit stopper 13 for restricting upper limit positions (non-key-depression positions) of the white keys 20 and the black keys 30. Key depression switches 14 are provided on a circuit board, not shown, disposed on the key frame 10 so as to respectively correspond to the white keys 20 and the black keys 30.

The white keys 20 and the black keys 30 are respectively provided with pendent portions 21, 31 and actuators 22, 32 vertically hung therefrom. The pendent portions 21, 31 have lower end portions thereof extending rearward for contact with the upper limit stopper 13, thereby restricting the upper limit positions of the white keys 20 and the black keys 30. When any of the white keys 20 and black keys 30 is depressed, a corresponding one of the actuators 22, 32 depresses the key depression switch 14 concerned. As a result, the key depression is detected, and an electronic sound is generated from a musical tone generator, not shown.

The white keys 20 each have a key main body portion thereof comprised of a base portion 23, an upper plate portion (upper plate body) 24, and a front edge 25. The base portion 23 is formed by a wood member or a woody member and formed with a hole 23*a* through which the pendent portion 21 passes. Further, the base portion 23 is formed with a hole 23*b* through which the actuator 22 passes and a hole 23*c* in which the white key 20 is pivoted around the key fulcrum portion 11.

The upper plate portion 24 is formed into a plate shape and fixed to the upper surface of the base portion 23 using adhesive or the like. The upper surface 24*a* of the upper plate portion 24 provides a key depression surface adapted to be depressed. The pendent portion 21 and the actuator 22 are hung from a lower surface of the upper plate portion 24. The front edge 25 is fixed to a front surface of the base portion 23 using adhesive or the like. In the black keys 30, the pendent portion 31 and the actuator 32 are hung from a lower front end of the key main body portion 33. An upper surface 33*a* of the key main body portion 33 provides a key depression surface adapted to be depressed. The upper plate portion 24 and the front edge 25 are each formed by a thin-plate like member which has a thickness of about 0.5 to 3 mm.

The following is an explanation of a material used for forming the upper plate portion 24 and the like. The material for forming the upper plate portion 24 and the like is mainly comprised of an AS (acrylonitrile-styrene) resin into which stone powder and white-colored colorant are mixed. As the stone to be crushed into powder, there may be used a stone composed of silicate calcium, calcium carbonate, diatomous earth, etc. As the white-colored colorant, there may be used a milky-white pigment or the like (for example, titanic oxide, titanium dioxide, zinc oxide, white lead, lithopone, etc.). When such a material is molded into a key, fine irregularities are produced on its surface to have a porous structure. The resultant member has sweat-absorbability and desired sliding resistance. Such a member is analogous to ivory and greatly suitable to carry out a performance. Specifically, the upper plate portion 24, etc. are made of a porous material mainly composed of the AS resin.

The content of the stone powder may be in the range from 3 to 50% by weight in order to attain properties suitable to carryout a performance. To realize an upgraded keyboard apparatus, the content of the stone power is preferably in the range from 10 to 30% by weight.

On the other hand, a material of black keys 30 is the same as the material of the upper plate portion 24 and the like, except for a colorant mixed therein. As a black-colored colorant for the black keys 30, black-colored pigment or the like is used (for example, carbon black, iron oxide, or the like).

The upper plate portion 24, etc. of the white keys 20 and the black keys 30 can be formed by any porous members if they have sweat-absorbability and are made of the same member (material) except only for colorant. Furthermore, any other materials can be used. For example, there may be a so-called artificial ivory or the like described in Japanese Patent Publication No. 06-031938.

In the white key 20, the upper plate portion 24, the pendent portion 21, and the actuator 22 are molded integrally with one another in a mold injection machine using the above described material. The front edge 25 is molded in the mold injection machine using the same material (including the same colorant) as the material of the upper plate portion 24, etc. Then, the pendent portion 21, the actuator 22, and the key fulcrum portion 11 are inserted through the holes 23*a*, 23*b* and 23*c* of the base portion 23, respectively, and the lower surface of the upper plate portion 24 is adhesive fixed to the upper surface of the base portion 23. Furthermore, the front edge 25 is adhesive bonded to the front surface of the base portion 23. As a result, the fabrication of one white key 20 is completed. On the other hand, in the black key 30, the key main body portion 33, the pendent portion 31, and the actuator 32 are molded integrally with one another in the mold injection machine using the above described material.

The resultant white keys 20 and the black keys 30 have the upper surfaces 24*a*, 33*a*, which serve as the key depression surfaces and which are only different in terms of colorant and are completely the same in terms of performance-related properties. Thus, there is no difference in tactile impression between when the white keys are played and when the black keys are played. In addition, the white keys 20 and the black keys 30 are the same in appearance except for color, thereby being given a quality appearance. Especially the black keys 30 have properties and appearance comparable to those of conventional black keys made of ebony wood.

According to the present embodiment, it is possible to provide the white keys 20 and the black keys 30 with a satisfactory tactile impression and a satisfactory appearance, and suppress a difference in tactile impression between when the white keys 20 are played and when the black keys 30 are played to a minimum.

The front edge 25 can be fabricated, not separately from the upper plate portion 24 but integrally therewith. In that case, the upper surface and the front surface of each white key 20 can have a sense of uniformity, which provides an upgraded appearance.

The pendent portion 21 and the actuator 22 can be constructed not integrally with the upper plate portion 24 but separately therefrom. The pendent portion 31 and the actuator 32 can also be constructed not integrally with the key main body portion 33 but separately therefrom. In that case, the pendent portions 21, 31 and the actuators 22, 32 can be made of materials that are not the same as the materials of the upper plate portion 24 and the key main body portion 33.

From the viewpoint of providing an upgraded appearance and reducing a difference in tactile impression between when the white keys are played and when the black keys are played, it is not required to construct all of the upper plate portions 24 and the key main body portions 33 using the porous material having sweat-absorbability. It is sufficient to use such a porous material for at least the upper surfaces 24*a*, 33*a* which form the key depression surfaces. For example, the upper plate portions 24 can each be formed in layers, and the porous material having sweat-absorbability can be used only for the uppermost layer thereof.

In the present embodiment, the upper plate portions 24, etc. of the white keys 20 and the black keys 30 are formed by the same member except for the coloring material. In that case, they are completely the same in appearance except for color, which can provide an artificial impression and thus there is a fear that an upgraded appearance can be diminished. In this regard, the upper plate portions 24 of the white keys 20 and the upper surfaces 33*a* of the key main body portions 33 of the black keys 30, which serve as the key depression surfaces, can intentionally be made different in surface roughness.

Figure 2A:
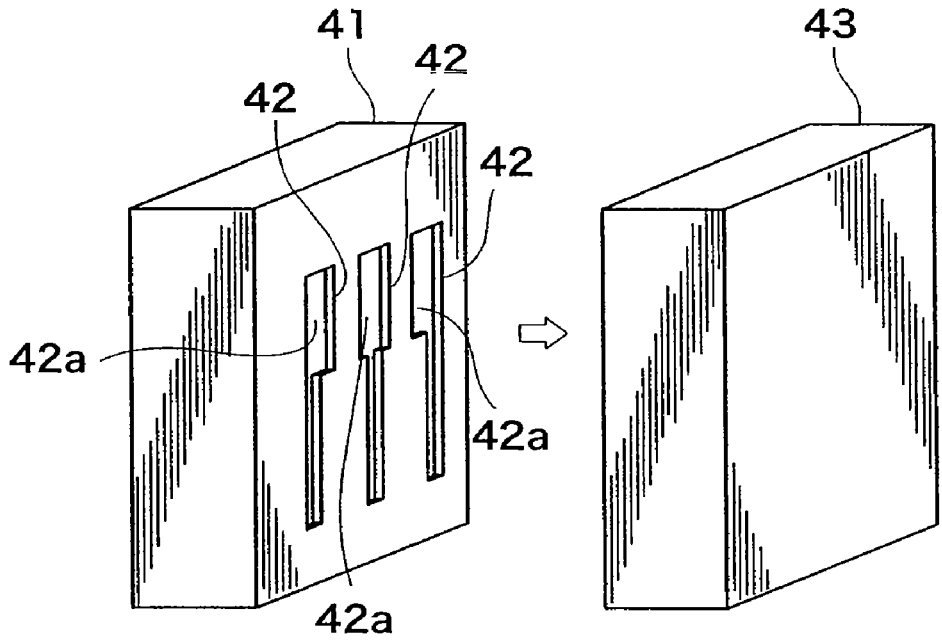
FIG. 2A is a schematic perspective view showing an example of a mold assembly used for forming upper plate portions of white keys.
Figure 2B:
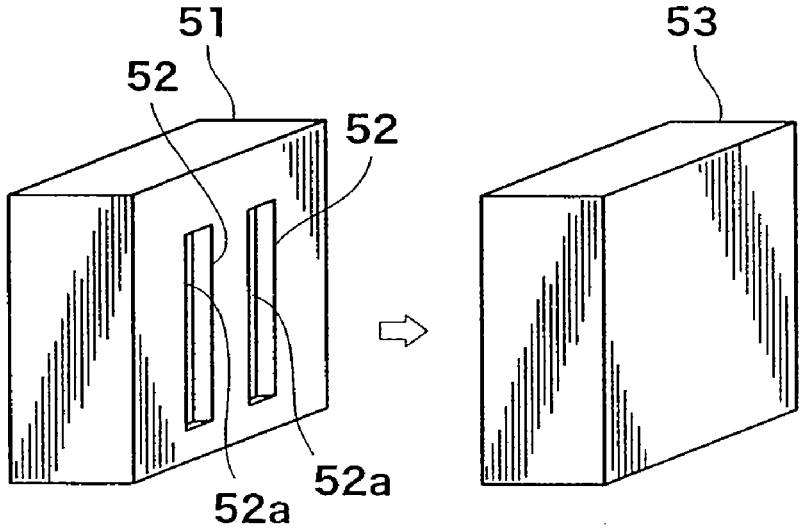
FIG. 2B is a schematic perspective view showing an example of a mold assembly used for forming key main body portions of black keys.

FIGS. 2A and 2B are schematic views showing examples of mold assemblies respectively used for forming upper plate portions 24 of white keys 20 and key main body portions 33 of black keys 30. In the examples shown in FIGS. 2A and 2B, the mold assembly for white keys 20 has a first die 41 and a second die 43 and the mold assembly for black keys 30 has a first die 51 and a second die 53. The first die 41 is formed with cavities 42 corresponding to upper plate portions 24, and the first die 51 is formed with cavities 52 corresponding to key main body portions 33.

In a case where the upper surfaces 24*a*, 33*a* are made to have different surface roughnesses, either one of the upper surfaces is formed into a mirror finished surface and another upper surface is formed into a minute irregular surface, for example. In surface treatment processes, the desired surface roughnesses can be attained by adjusting the surface roughnesses of bottom surfaces 42*a*, 52*a* of the first dies 41, 51 respectively corresponding to the upper surfaces 24*a*, 33*a*. The irregular surface can be provided to the die by an embossing method. In that case, a difference in surface roughnesses of the upper surfaces 24*a*, 33*a* is made small enough to cause little difference in tactile impression. The presence and absence of minute irregularities on the upper surfaces 24*a*, 33*a* mainly produce an external difference rather than a difference in tactile impression. Thus, the upper surfaces 24*a*, 33*a* can have different appearances, without giving influences upon the tactile impression.

In this manner, by making the white keys 20 and the black keys 30 different in appearance, artificial impression thereof can be suppressed.

Figure 3:
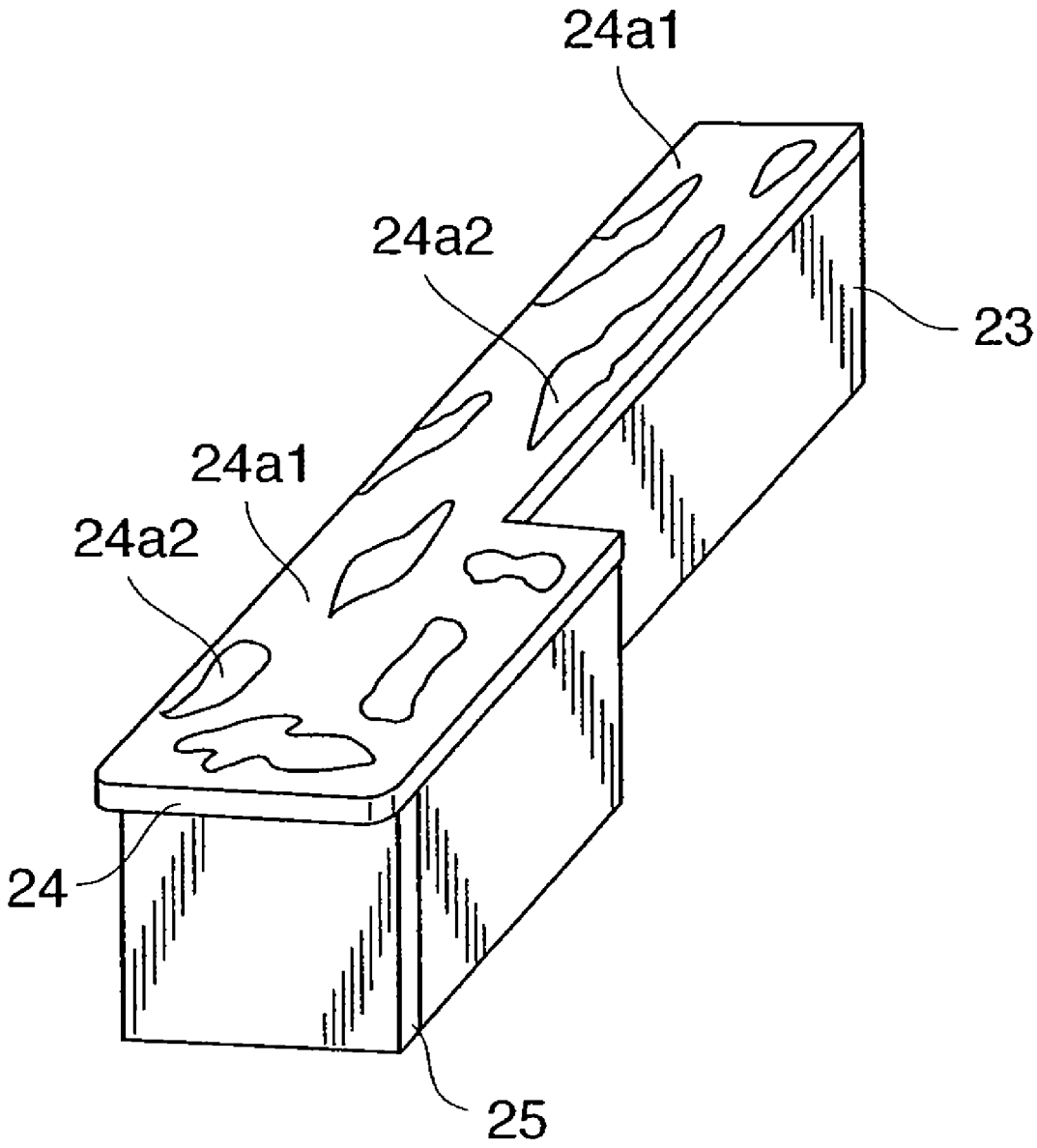
FIG. 3 is a perspective view showing the construction of a white key of a keyboard apparatus for an electronic musical instrument according to a second embodiment of this invention.

Next, an explanation is given of a second embodiment of this invention. FIG. 3 is a perspective view showing the construction of a white key of a keyboard apparatus for an electronic musical instrument according to the second embodiment.

In this embodiment, the white keys 20 each have the same or similar shape as that in the first embodiment, and the upper plate portion 24 has an unevenly finished upper surface 24*a* unlike the upper surface 24*a* of the first embodiment which is made uniform in surface roughness.

As shown in FIG. 3, on the upper surface 24*a* of the upper plate portion 24, there are irregularly disposed lustered portions 24*a*1 having a higher visible light reflectance and delustered portions 24*a*2 having a visible light reflectance lower than that of the lustered portions 24*a*1 and seen clouded.

Such a difference in visible light reflectance on the same one plane can be realized by adjusting conditions of injection molding. For example, the reflectance difference can be obtained by changing either one or both of (a) resin temperature and (b) injection speed from that/those in normal conditions suitable for forming the upper surface 24*a* having a uniform surface roughness.

Under the extremely strict management of the conditions, the surface can be formed into a uniformly finished surface. By changing one or both of the conditions (a) and (b), the lustered portions 24*a*1 and the delustered portions 24*a*2 can be formed on the upper surface 24*a* of the upper plate portion 24, without influencing upon molding quality. As a result, the difference in visible light reflectance can be provided at random positions. The molding conditions can slightly be changed at each molding cycle under computer control.

Other white keys 20 are molded in a similar manner, and the simultaneously molded white keys can have different patterns of lustered portions and delustered portions. As a result, the white keys 20 in one keyboard apparatus have not the same pattern. Similarly, on the upper surface 33*a* of the key main body portion of the black key 30, the visible light reflectance can randomly be made different depending on the position.

Alternatively, another method can be adopted that uses a plurality sets of dies having different patterns of lustered portions and delustered portions. In that case, the number of patterns of the resultant white keys 20 is limited, although the molding itself can be performed in normal conditions. It is preferable that the number of sets of the dies should be increased so that there are no white keys of the same pattern in the same keyboard apparatus. These dies are fabricated as described below.

For a predetermined portion of each die (for example, the bottom surface 42*a* shown in FIG. 2A) corresponding to the upper surface 24*a* of the upper plate portion 24, there are determined (i) the area of regions corresponding to the lustered portions 24*a*1, (ii) the number of the regions corresponding to the lustered portions 24*a*1, (iii) the shape of each of the regions corresponding to the lustered portions 24*a*1, and (iv) the positions where the regions corresponding to the lustered portions 24*a*1 are disposed.

Each of the determinations (i) to (iv) is performed by selecting a desired one from predetermined choices or by determining a value within a predetermined range, using a random generator, for example. Then, in accordance with results of the determinations, the regions corresponding to the lustered portions 24*a*1 are formed in the predetermined portion of the die.

According to the present embodiment, upgraded white keys can be obtained, while suppressing an artificial impression of the material of the white keys.

From the viewpoint of suppressing an artificial impression of the material, the regions of each die corresponding to the lustered portions 24*a*1 can be formed so as to be slightly projected or recessed stepwise from other regions instead of making the visible light reflectance on the upper surface 24*a* uneven.

In the first and second embodiments, each white key 20 (specifically, the base portion 23 thereof) has its exposed side surfaces. Alternatively, a member of the same material as that of the upper plate portion 24 can be provided on the side surfaces of the white key 20.

For example, portions respectively corresponding to the upper plate portion 24 and the side surfaces of the white key 20 are integrally formed using a porous material having sweat-absorbability, which is the same as the porous material for the upper plate portion 24, and the thus formed portions are adhesive bonded to the base portion 23 so as to surround the same. In that case, a portion corresponding to the front edge 25 can be formed integrally with the aforementioned portions. Alternatively, the portion corresponding to the side surfaces of the white key 20 can be formed separately from the upper plate portion 24 and then adhesive bonded to the base portion 23. In that case, the portion corresponding to the side surfaces is formed by a thin-plate-like member having a thickness in the range from about 0.5 to 3 mm.

The portion corresponding to the upper plate portion 24, the portion corresponding to the front edge 25, and the portion corresponding to the side surfaces can each be formed by the porous material. In that case, these three portions can be constructed separately from one another, or either two or all of the three portions can be formed integrally.

The base portion 23 can be formed by the porous material, instead of forming the thin-plate-like upper plate portion 24 and the front edge 25. Specifically, the base portion 23 is constructed such that the upper surface and the front surface thereof made of the porous material respectively achieve the functions of the upper plate portion 24 and the front edge 25. In that case, the portion corresponding to the side surfaces can be formed into a thin porous plate separately from the base portion 23.

Alternatively, instead of providing the thin-plate-like upper plate portion 24 and the front edge 25, a resin containing a porous material can be blown onto the upper surface and the front surface of the base portion 23 not made of a porous material. In that case, the base portion 23 applied with the resin can be subjected to thermal pressure bonding so as to obtain a structure having a smooth mirror-finished surface. Alternatively, there can be obtained a structure in which a porous resin is thermally bonded by two-color molding to the upper surface and the front surface of the base portion 23 not made of a porous material.

Figure 4A:
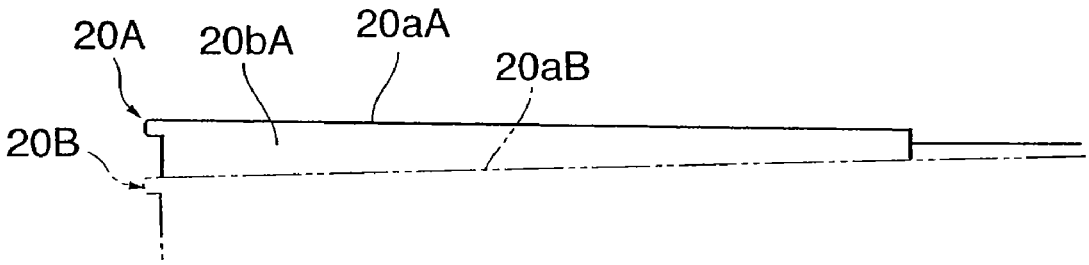
FIG. 4A is a fragmentary schematic view for explaining a visible part of a side surface of a white key.

As for the portion corresponding to the side surfaces of the white key 20, at least all the visible parts 20*b*A thereof each adapted to be visible when the right- or left-side adjacent key (white key 20B) is in a depressed state are formed by the porous material having sweat-absorbability, as shown in FIG. 4A.

As a result, the side surfaces of the white keys 20 can have the same appearance and the same tactile impression as those of the upper surfaces thereof, making it possible to suppress a difference in tactile impression between when the white keys 20 are played in a normal performance and when the white keys are played in a glissando as well as improve the appearance during the performance.

Figure 4B:
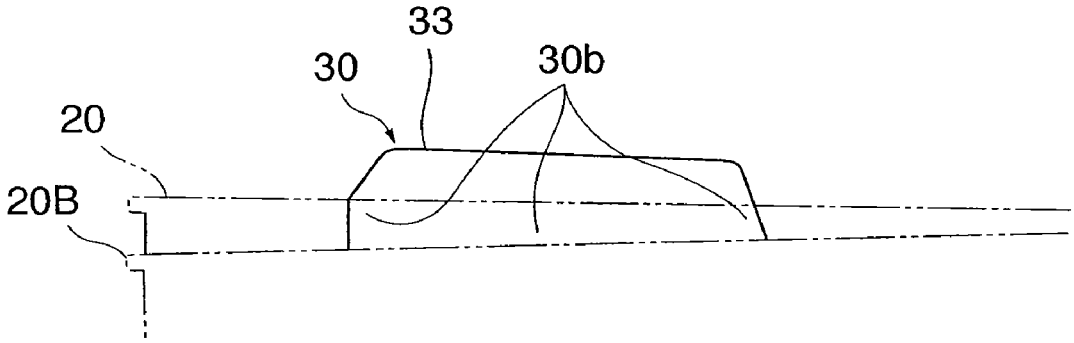
FIG. 4B is a fragmentary schematic view for explaining a visible part of a side surface of a black key.

As shown in FIG. 4B, the above can also be applied to the black keys 30. Specifically, at least all the visible parts 30*b* of the side surfaces of the key main body portions 33 of the black keys 30 can be formed by the porous material having sweat-absorbability, each visible part being a part that becomes visible when the right- or left-side adjacent key (white key 20B) is in a depressed state.

It is sufficient that at least the visible parts 20*b*A, 30*b* are formed by the porous material having sweat-absorbability, and therefore, other parts not visible during the performance and the non-performance can be formed by a material other than the porous material.

As for the keys having side surfaces thereof formed by the porous material having sweat-absorbability, the upper surfaces 24*a*, 33*a* can have different surface roughnesses (see, FIG. 2), and the upper surface 24*a* of the upper plate portion 24 can have a non-uniform visible light reflectance as with the case of the second embodiment.

What is claimed is:

1. A keyboard apparatus for an electronic musical instrument, comprising:

a plurality of white keys, each white key having an upper surface and supported for pivotal motion by a key support member; and a plurality of black keys, each black key having an upper surface and a main body and supported for pivotal motion by the key support member, wherein the upper surfaces of said white keys are each formed by a first porous member having sweat-absorbability, and the upper surfaces of said black keys are each formed by a second porous member that is different only in colorant from the first porous member and each of said upper surfaces of said black keys is molded integrally with the main bodies of said black keys by injection molding.

2. A keyboard apparatus for an electronic musical instrument according to claim 1, wherein the upper surfaces of said white keys are different in surface roughness from the upper surfaces of said black keys.

3. A keyboard apparatus for an electronic musical instrument according to claim 1, wherein each of said white keys has a front edge thereof formed by a member which is the same, including a colorant, as the first porous member forming the upper surfaces of said white keys.

4. A keyboard apparatus for an electronic musical instrument according to claim 1, wherein the upper surfaces of said white keys are adapted to reflect visible light and each have a visible light reflectance that varies depending on a position on the upper surface of each of said white keys so as not to be uniform throughout the upper surface of the white key.

5. A keyboard apparatus for an electronic musical instrument according to claim 1, wherein each of said white keys has a side surface thereof including a visible part that becomes externally visible when at least an adjacent key is in a depressed state, the visible part being formed by a member that is the same as the first porous member forming the upper surfaces of said white keys.

6. A keyboard apparatus for an electronic musical instrument according to claim 1, wherein each of said white keys includes a base portion thereof having an upper surface and forming a key main body, and a plate-like upper plate body fixed to the upper surface of the base portion, and the upper plate body is formed by the first porous member.

7. A keyboard apparatus for an electronic musical instrument according to claim 1, each of the first and second porous members is mainly comprised of a resin.

8. A keyboard apparatus for a musical instrument, comprising:

a plurality of white keys, each white key having an upper surface thereof adapted to reflect visible light and supported for pivotal motion by a key support member; and a plurality of black keys, each black key having an upper surface and a main body and supported for pivotal motion by the key support member, wherein the upper surfaces of said white keys are each formed by a porous member having sweat-absorbability, and each of said upper surfaces of said white keys has a visible light reflectance varying depending on a position the upper surface of the white key so as not to be uniform throughout the upper surface of the white key, and the upper surfaces of said black keys are each formed by another porous member that is different only in colorant from the porous member and each of said upper surfaces of said black keys is molded integrally with the main bodies of said black keys by injection molding.

9. A keyboard apparatus for a musical instrument according to claim 8, each of said white keys includes a base portion thereof having an upper surface and forming a key main body, and a plate-like upper plate body fixed to the upper surface of the base portion and formed by the porous member.

10. A keyboard apparatus for a musical instrument according to claim 8, the porous member is mainly comprised of a resin.

11. A keyboard apparatus for an electronic musical instrument, comprising:

a plurality of white keys, each white key having an upper surface and supported for pivotal motion by a key support member; and a plurality of black keys, each black key having an upper surface and a main body and supported for pivotal motion by the key support member, wherein the upper surfaces of said white keys are each formed by a porous member having sweat-absorbability, and wherein said white keys each have a side surface thereof including a visible part that becomes externally visible when at least an adjacent key is in a depressed state and that is formed by a member that is the same as the porous member of the upper surface of the white key, and the upper surfaces of said black keys are each formed by another porous member that is different only in colorant from the porous member and each of said upper surfaces of said black keys is molded integrally with the main bodies of said black keys by injection molding.

12. A keyboard apparatus for an electronic musical instrument according to claim 11, said white keys each include a base portion thereof having an upper surface and forming a key main body, and a plate-like upper plate body fixed to the upper surface of the base portion and formed by the porous member.

13. A keyboard apparatus for an electronic musical instrument according to claim 11, wherein the porous member is mainly comprised of a resin.

* * * * *